US005585835A

United States Patent [19]

Whritenor et al.

[11] Patent Number: 5,585,835

[45] Date of Patent: Dec. 17, 1996

[54] THERMAL PRINTER HAVING DUAL RECEIVER TRANSPORT PATHS

[75] Inventors: James A. Whritenor, Mendon; Joseph S. Kuzniarek, Hilton, both of N.Y.

[73] Assignee: Eastman Kodak Company, Rochester, N.Y.

[21] Appl. No.: 32,952

[22] Filed: Mar. 17, 1993

[51] Int. Cl.[6] ..... B41J 13/03; B41J 13/036

[52] U.S. Cl. ..... 347/218

[58] Field of Search ..... 346/134, 136, 346/76 PH; 400/120, 624, 625, 634, 636, 637, 642; 347/218, 215

[56] References Cited

U.S. PATENT DOCUMENTS

| | | | |
|---|---|---|---|
| 4,505,603 | 3/1985 | Yana | 400/120 |
| 4,532,525 | 7/1985 | Takahashi | 346/76 PH |
| 4,616,236 | 10/1986 | Watanabe et al. | 346/76 PH |
| 4,755,833 | 7/1988 | Tanigawa et al. | 346/76 PH |
| 4,755,834 | 7/1988 | Kunimitsu et al. | 346/76 PH |
| 4,838,719 | 6/1989 | Une | 400/618 |
| 4,881,831 | 11/1989 | Takita et al. | 400/120 |
| 4,962,386 | 10/1990 | Hakkaku et al. | 346/1.1 |
| 4,972,207 | 11/1990 | Ishiyama et al. | 346/76 PH |
| 4,985,711 | 1/1991 | Nakamura et al. | 346/76 PH |
| 5,009,527 | 4/1991 | Yana et al. | 400/120 |
| 5,011,314 | 4/1991 | Fujii | 400/619 |
| 5,399,031 | 3/1995 | Whritenor | 400/120.16 |

*Primary Examiner*—Huan H. Tran
*Attorney, Agent, or Firm*—Milton S. Sales

[57] ABSTRACT

A thermal printer has a platen roller and a moveable print head. A paper guide is positioned for guiding a sheet receiver media to an entrance between the platen and the print head when the print head is in the nonprinting position. A capstan pinch roller is movable relative to a capstan roller to grip the dye receiver therebetween. The capstan roller meters the receiver in a forward direction along the paper guide prior to metering the receiver in a reverse direction not along the paper guide and again in the forward direction not along the paper guide. The receiver media travels along two different transport paths.

2 Claims, 3 Drawing Sheets

THERMAL PRINTER HAVING DUAL RECEIVER TRANSPORT PATHS

FIELD OF THE INVENTION

The present invention relates generally, to thermal printing, and, more particularly, to an apparatus and method for achieving color registration in a sheet feed thermal printer.

BACKGROUND OF THE INVENTION

In a color thermal printing process, the finished print is made by successively transferring yellow, magenta, and cyan dyes from respective dye donors onto a dye receiver. Because the dyes are applied as color separations from the dye donors one at a time, it is desirable to align or register each color separation with the previous color separation so that the finished print is perfectly aligned and crisp. Earlier thermal printers had large drums to which a sheet of receiver media was attached. The drum was then rotated as each dye color separation was applied. The drum always rotated in the same path and it was fairly easy to achieve acceptable color registration. However, a drum large enough to accommodate a regular letter size sheet of paper caused the printer to be a bulky machine.

More modern printers have smaller platen-styled printing drums, on the order of an inch or so in diameter. The reduced size of the printing drum creates problems with color registration. There are several printer transport mechanisms that include capstans and pinch rollers for controlling the receiver during printing, as disclosed in U.S. Pat. Nos. 4,881,831; 4,755,833; 4,532,525; and 4,505,603. These small platen printer patents disclose transport systems for transporting the dye receiver material past the print head. While acceptable image reproduction quality is achievable, each of these prior art patents uses a continuous roll, and the technology necessary to print high resolution, high density images cannot be achieved in a single sheet system by the prior art devices.

In prior printers, dye transmission errors are created when the tension in the section of the dye receiver between the print head and the receiving media control system varies from slack to taut, repeatedly. Such tension variation will cause receiver speed changes at the print head; resulting in undesirable light and dark printed bands at the same frequency.

Another problem with the prior art small print drum printers is curling of the completed print. Curling is thought to be caused by the high temperatures necessary to achieve darken image printing. It will be appreciated that it is highly desirable to have a thermal printer which produces high quality prints without light or dark bands and without curling.

Since each of these prior art patents cited above uses a continuous roll, there is no possibility of having the wrong length of receiver in the machine. But single sheet fed thermal printers are also known, and it would be highly desirable to have a feature in such a sheet fed thermal printer that would prevent the operator from using the wrong length of dye receiver.

Another problem in conventional thermal printing is improper receiver position perpendicular to the path of motion, known as skew. Skew results in the image being mispositioned in a side to side fashion on the dye receiver. Accordingly, it will be appreciated that it would be highly desirable to have a thermal printer wherein good side to side positioning of the image on the media is assured.

SUMMARY OF THE INVENTION

The present invention is directed to overcoming one or more of the problems set forth above.

According to one aspect of the present invention, a thermal printer comprises a platen roller, a print head movable between a printing position at which the print head is in printing contact with the platen to effect transfer of thermal dye from a dye donor onto a dye receiver pressed between the platen and the print head and a nonprinting position at which the print head is spaced from the platen, a paper guide positioned for guiding the receiver to an entrance between the platen and the print head when the print head is in the nonprinting position, and a capstan pinch roller movable relative to the capstan roller between an open position at which the capstan pinch roller is spaced from the capstan roller and a closed position at which the capstan pinch roller abuts from the capstan roller to grip the dye receiver therebetween. The capstan roller meters the receiver in a forward direction along the paper guide prior to metering the receiver in a reverse direction not along the paper guide and in the forward direction not along the paper guide.

A platen pinch roller is movable between a printing position at which the pinch roller is in printing contact with the platen to hold the dye receiver against the platen and a nonprinting position at which the pinch roller is spaced from the platen. The platen pinch roller is positioned to move the receiver away from the paper guide and towards the platen during movement from the nonprinting position to the printing position.

According to another aspect of the invention, a method for producing a thermal print comprises the steps of urging a sheet of receiver media toward a paper guide; guiding the receiver sheet to an entrance between a printing platen and a print head when the print head is in a nonprinting position at which the print head is spaced from the platen; guiding the receiver sheet to a position between a capstan roller and a capstan pinch roller, the capstan pinch roller being movable relative to the capstan roller between an open, or not gapped but simply unloaded, position at which the capstan pinch roller is spaced, or unloaded, from the capstan roller and a closed position at which the capstan pinch roller abuts from the capstan roller to grip the dye receiver therebetween; gripping the receiver sheet between the capstan roller and the capstan pinch roller; metering the receiver in a forward direction along the paper guide; metering the receiver in a reverse direction not along the paper guide; and metering the receiver in the forward direction not along the paper guide.

Holding a printing surface of the receiver away from the paper guide, with the platen pinch roller, prevents scratching of the printing surface by the paper guide. Urging the receiver along the paper guide towards the print head is accomplished with a secondary motion roller that is positioned along the paper guide. Staging the receiver prior to each print pass is accomplished by metering the receiver a short distance in the reverse direction not along the paper guide, lowering the print head to a printing position, and metering the receiver with the capstan roller to a first print line position. Creating a preselected amount of drag, with the print head at the print position, and uniformly tensioning a portion of the receiver between the print head and a nip between the capstan roller and the capstan pinch roller may be a step of the method.

These and other aspects, objects, features and advantages of the present invention will be more clearly understood and appreciated from a review of the following detailed description of the preferred embodiments and appended claims, and be reference to the accompanying drawings.

DETAILED DESCRIPTION OF THE PREFERRED EMBODIMENTS

Figure 1:
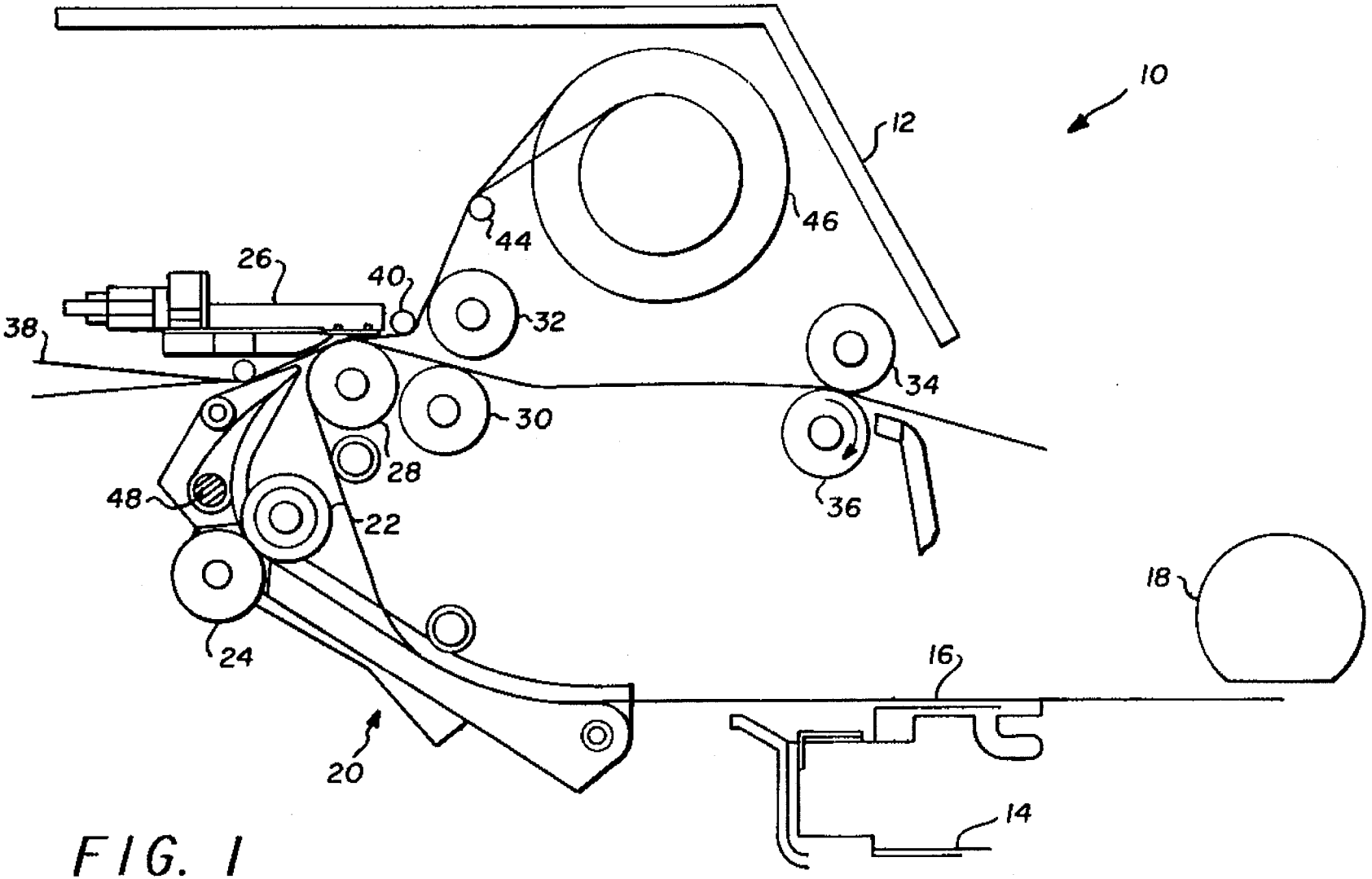
FIG. 1 is a diagrammatic side view of a thermal printer illustrating an initial receiver of media loading path.
Figure 2:
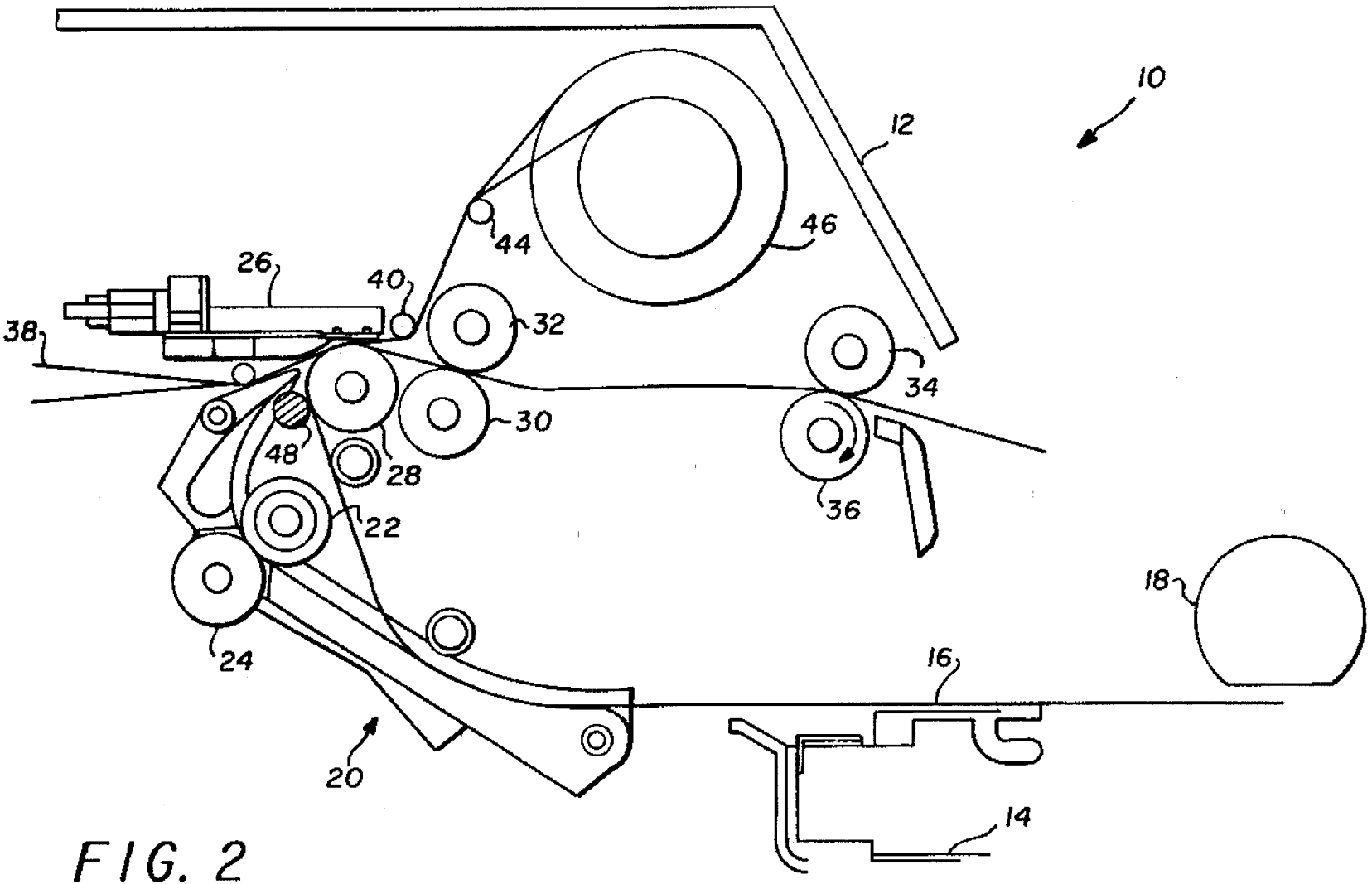
FIG. 2 is a side view similar to FIG. 1, but illustrating a second, unguided, media transport path.

Referring to FIGS. 1 and 2, a thermal printer 10 is illustrated with a cover 12 and a paper tray 14. A dye receiver 16, which in the illustrated embodiment is a sheet of media, is urged from the paper tray 14 by a picker mechanism such as a D-shaped picker roller 18. Picker roller 18 urges sheet of media into a paper guide assembly 20 where the media is engaged by secondary motion rollers 22 and 24 that urge it along the paper guide assembly 20 to the nip area between a print head 26 and a platen roller 28. Upon exiting the nip area between the print head and platen roller 28, receiver 16 goes to the nip between a capstan roller 30 and a capstan pinch roller 32. As illustrated, receiver 16 exits the thermal printer through exit rollers 34, 36.

In the print head area, printing occurs when dye from a dye donor web 38 is transferred onto receiver 16. Upon exiting the nip area of the print head, donor web 38 passes over idler roller 40 and over idler roller 44 to a donor take-up spool 46. A platen pinch roller 48 works in concert with platen roller 28, as explained in further detail below.

Figure 3:
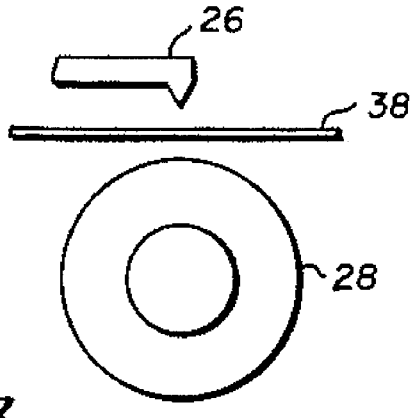
FIG. 3 is a diagram illustrating the print head an platen at the first nonprinting position for loading the dye donor.
Figure 4:
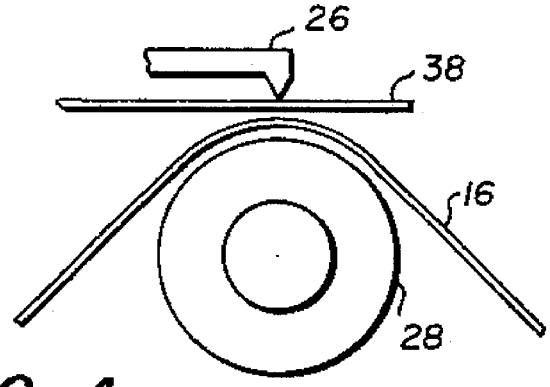
FIG. 4 is a diagram similar to FIG. 3, but illustrating the print head an platen at the second nonprinting position for loading the dye receiver.
Figure 5:
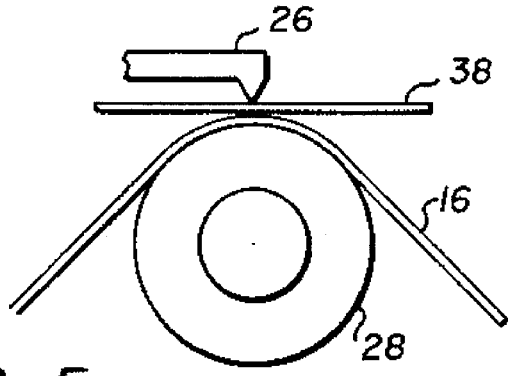
FIG. 5 is a diagram similar to FIGS. 3 and 4, but illustrating the print head an platen at the printing position.

Referring to FIGS. 3–5, print head 26 is preferably a three position print head that moves between (a) a fully opened position (FIG. 3) where print head 26 is spaced a preselected distance from platen roller 28 so that donor 38 clears the platen roller by a preselected amount; (b) an intermediate "receiver load" position (FIG. 4) where the print head is spaced an intermediate distance from platen roller 28; and (c) a print position (FIG. 5) at which print head 26 loads donor 38 and receiver 16 against platen roller 28 for printing.

Capstan pinch roller 32 is preferably movable relative to capstan roller 30 between an open position (FIG. 1) and a closed position (FIG. 2). At the closed position, the capstan pinch roller and the capstan roller grip dye receiver 16 therebetween for metering the dye receiver. At the open position, capstan roller 30 and capstan pinch roller 32 are spaced one from the other so that a sheet of media can move freely between the rollers.

Platen pinch roller 48 is preferably movable between a printing position (FIG. 2) at which the platen pinch roller is in contact with platen roller 28 to hold dye receiver 16 against the platen roller, and a nonprinting position at which pinch roller 48 is spaced from platen roller 28. At the nonprinting position, platen pinch roller 48 is moved away from platen roller 28 so that receiver 16 rides in the paper guide 20 to prevent scratching during the initial loading sequences of the cycle.

Platen pinch roller 48 is positioned to move receiver 16 away from paper guide 20 and towards platen roller 28 during movement from the nonprinting position to the printing position. This prevents scratching of the receiver during the printing sequences.

During printing, platen pinch roller 48 preferably wraps receiver 16 about platen roller 28 an amount sufficient for preventing both slip of the receiver on the platen and curling of the receiver.

The print head at the print position creates a preselected amount of drag on receiver 16 so that a portion of the receiver between the print head and the nip between capstan roller 30 and capstan pinch roller 32 is uniformly tensioned for each print pass.

Operation of the present invention will now be described by referring to FIGS. 1–5. During initialization, printer 10 checks by conventional means for receiver type and that paper path 20 is clear. Print head 26 is at its fully opened (FIG. 3) position. Platen pinch roller 48 and capstan pinch roller 32 are open. For clarity, the various sensors for determining the position of the media during the loading, staging and printing processes have not been illustrated in the drawings.

The receiver loading sequence begins with the print head 26 located away from the platen roller 28. This releases dye donor web 38 from any clamping pressure and leaves a gap between print head 26 and platen roller 28. A mechanism, such as a picker roller, picks a sheet of dye receiver 16 from supply tray 14 and directs it into guide assembly 20 which guides dye receiver 16 to secondary motion rollers 22, 24. The secondary motion rollers then urge the dye receiver to the gap between print head 26 and platen roller 28.

As the leading edge portion of receiver 16 exits the gap between the print head and the platen roller, the receiver transport path further guides the receiver to the receiver drive mechanism that includes capstan roller 30 and pinch roller 32. As receiver 16 approaches the receiver drive mechanism, pinch roller 32 moves away from capstan roller 30, forming a second gap. When dye receiver 16 passes through the second gap and is in the proper position, pinch roller 32 engages and presses the dye receiver 16 firmly between the receiver drive mechanism rollers 30, 32.

The receiver is now moved by a stepper motor rotating the capstan rollers until the trailing edge of the receiver is sensed by a sensor. The movement is 10 stopped and the number of motor pulses required to move the receiver this distance will indicate the length of the receiver. This length will be compared to the image length to be printed or the sheet length originally selected.

The receiver loading sequence is followed by advancing dye donor web 38 to the beginning of the next color group's first color patch, where dye patch sensors detect the beginning of the next color patch. If the next color patch is not detected by the time the receiver is properly positioned for printing, then the dye donor advances until the leading edge of the first color patch of the next group is located. Printing of the image then occurs, followed by print ejection.

Staging just prior to each print pass is another part of the dye receiver movement. When the receiver is sensed at the capstan area during forward movement, the movement is reversed for a short distance. The thermal print head is lowered and the receiver is moved forward by the capstan rollers to the first print line position. The print head creates a drag so that the section of receiver between the print head and the capstan roller nip is under the same tension for each cycle. This insures good color registration, as well as consistent density so that there are no dark or light bands caused by inconsistent tension.

Once the capstan pinch is closed, the platen pinch roller moves the dye receiver away from the entrance feed path to prevent scratches while the receiver is moving back and forth. It can then be moved into position on the platen roller to define the unguided print path.

There are three cycles of operation. During cycle 1 the print head moves to its fully opened position illustrated in FIG. 3 A receiver sheet is picked by a picker mechanism to urge it along the sheet guide in a first path. The platen motors turns on, and the sensor detects the leading edge of the sheet and verifies the pick. When the leading edge is sensed at the capstan area, the platen motor turns off and the capstan closes thereby closing the pinch. The print head next moves to the intermediate position shown in FIG. 4 and the capstan motor turns on forwardly for staging the receiver sheet. The trailing edge of the sheet is then sensed. The capstan motor is turned off in the forward direction and turned on in the reverse direction, and the platen motor is turned on in the reverse direction. When the lead edge of the sheet is sensed again, the platen and capstan motors are turned off.

Now, the donor is advanced to the first color patch, (say yellow) with both motors on. Once the first color patch is sensed, the supply motor is turned off while the take-up motor is left on. By operating both the stepper and platen motors, the capstan is rewound by a given number of pulses. Moving the head to the print, FIG. 5, position and advancing the receiver sheet by the given number of pulses are the final printing preparations. Printing now begins. The leading edge of the receiver sheet is sensed at the exit indicating printing is proceeding as desired. The stepper stops at the proper printing length, and the head moves to the fully opened position shown in FIG. 3 completing the first cycle.

Cycle 2 advances the donor to the second color (say, magenta) with both motors turned on. When the second color is sensed, the supply motor turns off, as with the first color, and cycle 2 continues as in cycle 1. The stepper stops at the proper printing length, and the head moves to its FIG. 3 position completing the second cycle.

Cycle 3 advances the donor to the third color (say, cyan) with both motors turned on. When the third color is sensed, the supply motor turns off, as with yellow and magenta, and cycle 3 continues as in cycles 1 and 2. The stepper stops at the proper printing length, and the head moves to its FIG. 3 position. Now, forward motion of the receiver sheet continues until the edge sensor senses the trailing edge of the receiver sheet. The capstan is opened. The stepper continues until a sensor senses the trailing edge at the exit thereby completing the third cycle.

While the invention has been described with reference to a sheet feed thermal printer, it is apparent that the staging is easily adapted to printers that are fed by a continuous receiver web. While the invention has been described with particular reference to a preferred embodiment, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A thermal printer of the type for transferring dye from a dye donor to a dye receiver, said printer comprising:

a platen roller;

a print head movable between a printing position at which said print head is in a printing position to effect thermal transfer of dye from the dye donor onto the dye receiver pressed between said platen roller and said print head and a non-printing position at which said print head is spaced from said platen roller;

a paper guide positioned for guiding said receiver to an entrance between said platen roller and said print head when said print head is in said non-printing position;

a capstan roller;

a capstan pinch roller movable relative to said capstan roller between an open position at which said capstan pinch roller is spaced from said capstan roller and a closed position at which said capstan pinch roller to grip said dye receiver between said capstan pinch roller and said capstan roller;

means for selectively driving said capstan roller to meter said receiver in forward and reverse directions; and means for sequentially guiding said receiver (1) along said paper guide when metered in a forward direction by the capstan roller selective driving means, (2) not along said paper guide when metered in a reverse direction by the capstan roller selective driving means, and (3) not along said paper guide when metered in said forward direction by the capstan roller selective driving means.

2. A method for producing a thermal print, comprising the steps of:

urging a receiver sheet toward a paper guide;

guiding said receiver sheet to an entrance between a printing platen and a print head when said print head is in a non-printing position at which said print head is spaced from said platen, said guiding step being effected by urging said receiver sheet along the paper guide by means of a secondary motion roller positioned along the paper guide;

guiding said receiver sheet to a position between a capstan roller and a capstan pinch roller, said capstan pinch roller being adjustable between an un-loaded state at which said capstan pinch roller is un-loaded from said capstan roller and a loaded state at which said capstan pinch roller and said capstan roller grip said receiver sheet therebetween;

gripping said receiver sheet between said capstan roller and said capstan pinch roller; and selectively moving the receiver sheet from the paper guide while:

(1) metering said receiver sheet in a forward direction along said paper guide, (2) metering said receiver sheet in a reverse direction not along said paper guide, and (3) metering said receiver sheet in said forward direction not along said paper guide.

* * * * *